US007412198B2

(12) United States Patent
Isemura et al.

(10) Patent No.: US 7,412,198 B2
(45) Date of Patent: Aug. 12, 2008

(54) IMAGE FORMING SYSTEM AND CLEAR COATING APPARATUS

(75) Inventors: Keizo Isemura, Koganei (JP); Ichiro Sasaki, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 11/755,323

(22) Filed: May 30, 2007

(65) Prior Publication Data

US 2007/0280759 A1 Dec. 6, 2007

(30) Foreign Application Priority Data

Jun. 1, 2006 (JP) ..... 2006-153665

(51) Int. Cl.
*G03G 15/20* (2006.01)
*G03G 15/00* (2006.01)

(52) U.S. Cl. ..... 399/341; 399/407

(58) Field of Classification Search ..... 399/341, 399/364, 407

See application file for complete search history.

(56) References Cited

U.S. PATENT DOCUMENTS

2003/0007814 A1* 1/2003 Richards ..... 399/341
2006/0133870 A1* 6/2006 Ng et al. ..... 399/341

FOREIGN PATENT DOCUMENTS

JP 03-013079 A 1/1991
JP 03102081 A * 4/1991
JP 09-200551 A 7/1997

* cited by examiner

*Primary Examiner*—Ryan Gleitz
(74) *Attorney, Agent, or Firm*—Rossi, Kimms & McDowell, LLP

(57) ABSTRACT

An image forming system which is capable of performing double-sided clear coating. The image forming system comprises an image forming apparatus configured to form an image on a sheet, and a clear coating apparatus configured to perform clear coating on the sheet using clear toner. The image forming apparatus is provided with a double-sided image forming function for forming images on the respective opposite sides of a sheet, and the clear coating apparatus is provided with a double-sided clear coating function for performing clear coating on the opposite sides of a sheet.

11 Claims, 6 Drawing Sheets

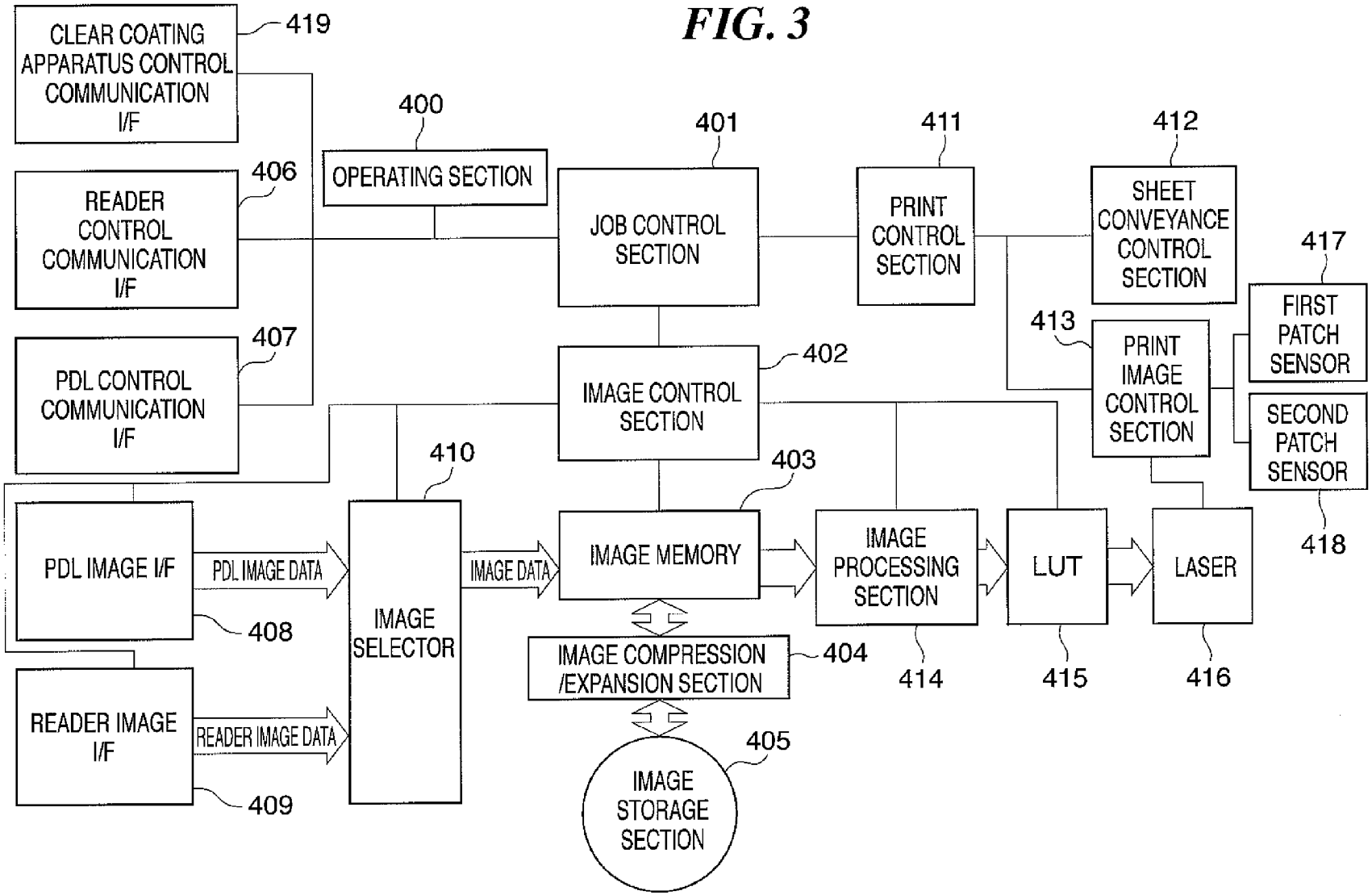
FIG. 3
400
OPERATING SECTION
401
JOB CONTROL SECTION
402
IMAGE CONTROL SECTION
403
IMAGE MEMORY
404
IMAGE COMPRESSION /EXPANSION SECTION
405
IMAGE STORAGE SECTION
406
READER CONTROL COMMUNICATION I/F
407
PDL CONTROL COMMUNICATION I/F
408
PDL IMAGE I/F
409
READER IMAGE I/F
410
IMAGE SELECTOR
411
PRINT CONTROL SECTION
412
SHEET CONVEYANCE CONTROL SECTION
413
PRINT IMAGE CONTROL SECTION
414
IMAGE PROCESSING SECTION
415
LUT
416
LASER
417
FIRST PATCH SENSOR
418
SECOND PATCH SENSOR
419
CLEAR COATING APPARATUS CONTROL COMMUNICATION I/F
IMAGE DATA
PDL IMAGE DATA
READER IMAGE DATA 501
JOB CONTROL SECTION
506
MAIN APPARATUS CONTROL COMMUNICATION I/F
511
PRINT CONTROL SECTION
512
SHEET CONVEYANCE CONTROL SECTION
502
IMAGE CONTROL SECTION
513
PRINT IMAGE CONTROL SECTION
503
IMAGE MEMORY
509
MAIN APPARATUS IMAGE I/F
IMAGE DATA
514
IMAGE PROCESSING SECTION
515
LUT
516
LASER
504
IMAGE COMPRESSION/ EXPANSION SECTION
505
IMAGE STORAGE SECTION

IMAGE FORMING SYSTEM AND CLEAR COATING APPARATUS

BACKGROUND OF THE INVENTION

1. Field of the Invention

The present invention relates to an image forming system comprised of an image forming apparatus that forms an image on a sheet, and a clear coating apparatus connected to the image forming apparatus on a downstream side of the same so as to perform clear coating on the sheet using clear toner which becomes clear (transparent) after being fixed on the sheet.

2. Description of the Related Art

In recent years, there has been an increasing demand for full-color electrophotographic image forming apparatuses ensuring high image quality. Further, it has been increasingly desired to realize a high-quality photographic tone image mode in an electrophotographic image forming apparatus, with proliferation of digital cameras as a major reason.

On the other hand, there has been proposed a clear coating apparatus that outputs a high-quality photographic tone image on a sheet and then coats the sheet with a toner image which will become clear after being fixed (see e.g. Japanese Laid-Open Patent Publication (Kokai) No. H03-13079). The clear coating apparatus can provide an image equivalent or close in glossiness to an image obtained by silver-salt photographic processing, by performing clear coating on a sheet.

There has also been proposed a technique for realizing an image forming process using Y (yellow), M (magenta), C (cyan), and Bk (black) toners and a clear coating process using a clear toner within a single image forming apparatus (see e.g. Japanese Laid-Open Patent Publication (Kokai) No. H09-200551).

However, the conventional clear coating apparatus is not configured to be able to automatically form clear toner images on the respective opposite sides of a sheet, and hence in order to form clear toner images on the respective opposite sides of a sheet, it is required to form an image on the front side of the sheet and then manually set the sheet discharged from the apparatus on a sheet feeder again. On the other hand, the image forming apparatus incorporating a clear coating device can perform clear coating only in the apparatus itself, and therefore the clear coating device lacks versatility.

Clear toner has a property of increasing its glossiness as the number of times of heat reception increases with increase in the number of times of passage through a fixing device. This property of clear toner can cause a difference in glossiness between the front and reverse sides of a sheet when clear coating is performed on the opposite sides of the sheet. For example, in a case where a front-side image forming process, a front-side clear coating process, a reverse-side image forming process, and a reverse-side clear coating process are executed in the mentioned order, clear toner on the front side passes through the fixing device three times, whereas clear toner on the reverse side passes through the fixing device only once. Therefore, a difference in glossiness is caused between the front side and the reverse side, which causes degradation of the quality of an output.

SUMMARY OF THE INVENTION

The present invention provides an image forming system and a clear coating apparatus, which are capable of performing double-sided clear coating and make it possible to enhance the versatility of the clear coating apparatus. Further, the present invention provides an image forming system and a clear coating apparatus, which are capable of reducing difference in glossiness between the front and reverse sides of a sheet having undergone double-sided clear coating.

In a first aspect of the present invention, there is provided an image forming system comprising an image forming apparatus configured to form an image on a sheet, and a clear coating apparatus configured to perform clear coating on the sheet using clear toner, wherein the image forming apparatus is provided with a double-sided image forming function for forming images on respective opposite sides of a sheet, and the clear coating apparatus is provided with a double-sided clear coating function for performing clear coating on opposite sides of the sheet.

The image forming apparatus and the clear coating apparatus can be disconnectably connected to each other.

The clear coating apparatus can comprise a receiving part configured to receive a sheet discharged from the image forming apparatus.

The clear coating apparatus can form a clear coating image on the sheet received by the receiving part.

The image forming apparatus and the clear coating apparatus can comprise respective control sections, and the control sections are connected to each other via a communication I/F.

The clear coating apparatus can comprises two photosensitive members.

The image forming apparatus can form images on respective opposite surfaces of a sheet and then delivers the sheet to the clear coating apparatus, and the clear coating apparatus performs clear coating on the opposite surfaces of the delivered sheet.

In a second aspect of the present invention, there is provided a clear coating apparatus connected to an image forming apparatus that forms an image on a sheet, so as to perform clear coating on the sheet using clear toner, comprising a receiving part configured to receive a sheet discharged from the image forming apparatus, and a double-sided clear coating device configured to perform clear coating on the opposite sides of the sheet received by the receiving part.

According to the present invention, the image forming apparatus and the clear coating apparatus are both equipped with the double-sided image forming function for forming images on the respective opposite sides of a sheet. Therefore, it is possible not only to perform double-sided clear coating, but also to enhance the versatility of the clear coating apparatus.

The above and other objects, features, and advantages of the invention will become more apparent from the following detailed description taken in conjunction with the accompanying drawings.

BRIEF DESCRIPTION OF THE DRAWINGS

FIG. 3 is a schematic diagram of the circuit configuration of the image forming apparatus.

DETAILED DESCRIPTION OF THE PREFERRED EMBODIMENTS

The present invention will now be described in detail below with reference to the drawings showing preferred embodiments thereof.

Figure 1:
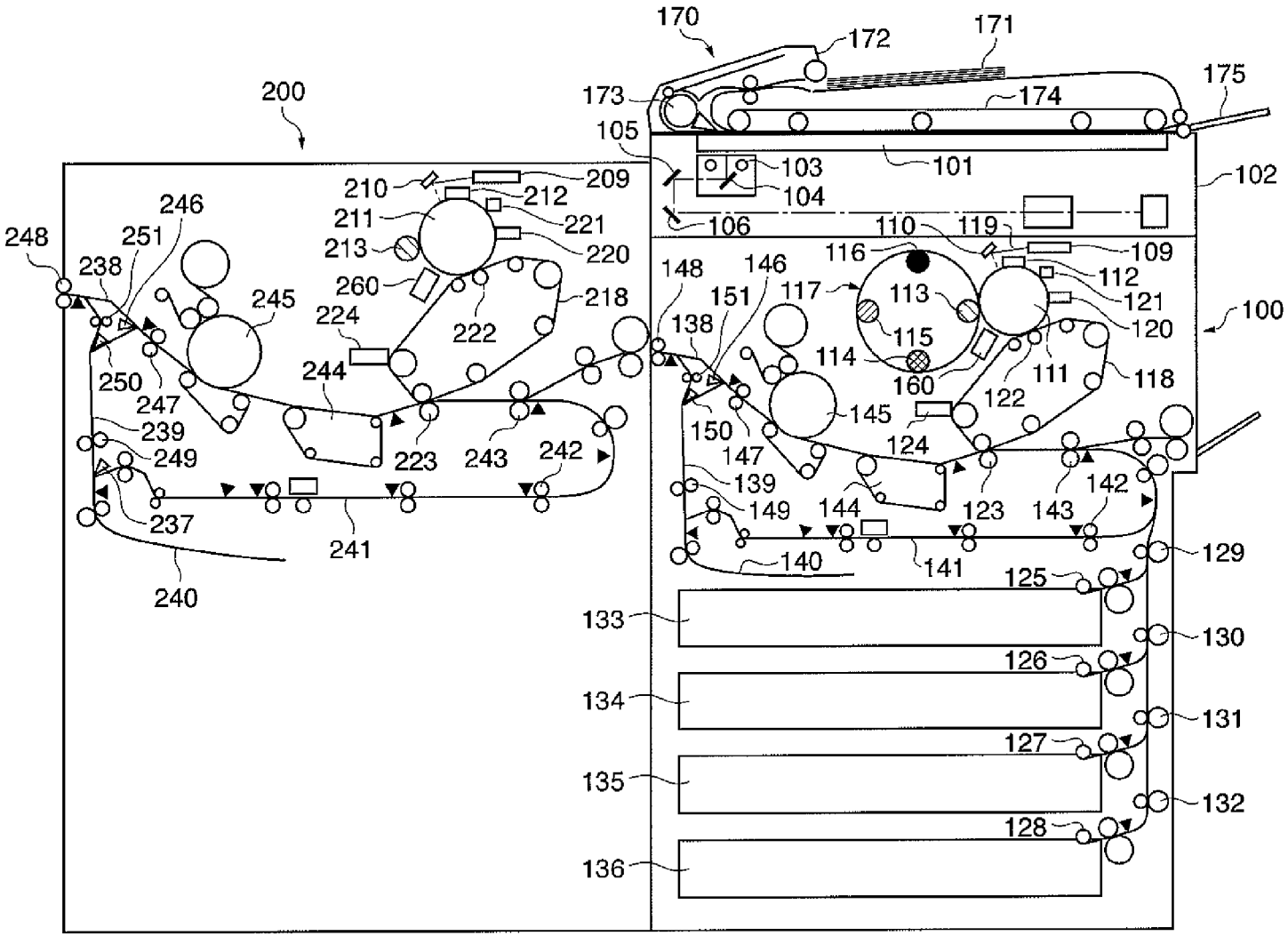
FIG. 1 is a schematic view of an image forming system according to a first embodiment of the present invention.

FIG. 1 is a schematic view of an image forming system according to the first embodiment of the present invention.

As shown in FIG. 1, the image forming system according to the present embodiment is comprised of an image forming apparatus 100, and a clear coating apparatus 200 connected to the image forming apparatus 100 on a downstream side of the same. In the present embodiment, the image forming apparatus 100 is described as a color image forming apparatus, but it may be a monochrome one.

The image forming apparatus 100 includes a platen glass 101 as an original platen, and a scanner 102. The scanner 102 is comprised of an original illuminating lamp 103, scanning mirrors 104 to 106, a lens 107, and an image sensor unit 108.

The scanner 102 is driven by a motor, not shown, to reciprocate for scanning in a predetermined direction. During this motion of the scanner 102, a reflected light from an original passes through the lens 107 via the scanning mirrors 104 to 106 to form an image on a CCD sensor provided in the image sensor unit 108.

The exposure control unit 109 is comprised of a laser, a polygon scanner, and so forth. The exposure control unit 109 causes a laser beam 119 modulated based on an image signal converted into an electric signal by the image sensor unit 108 and having undergone predetermined image processing, referred to hereinafter, to reflect on a reflecting mirror 110 to thereby irradiate a photosensitive drum 111 with the laser beam 119. The exposure control unit 109 of the image forming apparatus 100 will be described in more detail hereinafter with reference to FIG. 3.

Around the photosensitive drum 111, there are arranged a pre-exposure lamp 121 for erasing potential on the photosensitive drum 111, and a primary electrostatic charger 112 for applying potential to the photosensitive drum 111. The primary electrostatic charger 112 applies a high voltage to a wire to thereby generate corona discharge.

Further, around the photosensitive drum 111, there are arranged a developing rotary 117, an intermediate transfer member 118 for temporarily holding thereon an image developed on the photosensitive drum 111, a primary transfer roller 122 for transferring the image onto the intermediate transfer member 118, and a photosensitive drum cleaner 120.

Developing devices 113 to 116 filled with toners for developing an electrostatic latent image formed by irradiating the photosensitive drum 111 with the laser beam 119 are housed in the developing rotary 117 that sequentially brings the developing devices 113 to 116 into contact with the photosensitive drum 111.

The photosensitive drum 111 is rotated by a motor, not shown, and is charged to a desired potential by the primary electrostatic charger 112. Then, the laser beam 119 emitted from the exposure control unit 109 is reflected on the reflecting mirror 110 to be irradiated onto the photosensitive drum 111. This causes an electrostatic latent image to be formed on the photosensitive drum 111.

The developing rotary 117 rotates to bring the developing device 113 for a first color into contact with the photosensitive drum 111 and electrostatically applies a toner from the developing device 113 onto the electrostatic latent image on the photosensitive drum 111 to thereby form a toner image on the photosensitive drum 111.

In the case of forming a full-color image with toners of four colors contained in the respective developing devices 113 to 116, the first-color toner image developed on the photosensitive drum 111 is primarily transferred onto the intermediate transfer member 118 by the primary transfer roller 122. Then, the developing rotary 117 rotates to bring the developing device 114 for a second color into contact with the photosensitive drum 111.

At this time, the laser beam 119 is emitted again from the exposure control unit 109 in timing in which the leading end of the first-color toner image primarily transferred onto the intermediate transfer member 118 and that of a second-color toner image to be developed on the photosensitive drum 111 are perfectly aligned with each other at a position corresponding to the primary transfer roller 122.

Similarly to the first-color toner image, the second-color toner image is formed on the photosensitive drum 111 by the developing device 114 for the second color being brought into contact with the drum 111. The toner image is superimposed by the primary transfer roller 122 on the first-color toner image primarily transferred onto the intermediate transfer member 118. This superimposing operation is repeatedly carried out for a third color and a fourth color, whereby the full-color developed image of the four colors is eventually transferred onto the intermediate transfer member 118.

A sheet is fed from one of a first sheet feed cassette 133, a second sheet feed cassette 134, a third sheet feed cassette 135, and a fourth sheet feed cassette 136 by an associated one of pickup rollers 125 to 128. The sheet fed from the sheet feed cassette is conveyed toward a registration roller 143 by an associated one of feed rollers 129 to 132.

The sheet is conveyed to the vicinity of the registration roller 143 at rest, and then conveyed to a secondary transfer roller 123 by the registration roller 143 when the registration roller 143 is driven such that the leading end of the sheet is aligned with that of the developed image transferred onto the intermediate transfer member 118. Then, a transfer bias is applied to the secondary transfer roller 123, whereby the image is secondarily transferred onto the sheet. Thereafter, the sheet is conveyed to a conveyor belt 144.

On the intermediate transfer member 118, there remains residual toner which was not transferred onto the sheet by the secondary transfer roller 123. The residual toner is cleaned by an intermediate transfer member cleaner 124. The intermediate transfer member cleaner 124 is disposed in a manner contactable with the intermediate transfer member 118, and comes into contact with the intermediate transfer member 118 immediately before the leading end of the residual toner of the secondarily transferred image reaches the intermediate transfer member cleaner 124.

Then, the intermediate transfer member cleaner 124 is controlled to move apart from the intermediate transfer member 118 immediately before the leading end of a first-color developed image of a next toner image, which was transferred onto the intermediate transfer member 118 by the primary transfer roller 122, reaches the intermediate transfer member cleaner 124.

There also remains residual toner on the photosensitive drum 111 after the toner image thereon having been transferred onto the intermediate transfer member 118. This residual toner is cleaned by a photosensitive drum cleaner 120. Thereafter, residual charge on the photosensitive drum 111 is erased by the pre-exposure lamp 121.

The sheet with the image secondarily transferred from the intermediate transfer member 118 is conveyed to a fixing device 145 by the conveyor belt 144. The fixing device 145 is comprised of an upper heat roller, and a fixing belt for being pressed against the heat roller from below. The toner image secondarily transferred onto the sheet is fixed on the sheet by being pressed and heated by the fixing device 145. Then, the sheet is discharged from the image forming apparatus 100 by an inner discharge roller 147 and an outer discharge roller 148.

In FIG. 1, a discharge flapper 146 switches the course of a sheet between a conveying path 138 and an inverting path 139. In the case of double-sided recording (double-sided copying) for forming images on the respective opposite sides of a sheet, a sheet conveyed by the inner discharge roller 147 is advanced into the inverting path 139 by shifting the discharge flapper 146 upward, and conveyed into an inversion conveying path 140.

Thereafter, the advancing direction of the sheet is reversed by switching a flapper 137, whereby the sheet is guided into a refeed path 141 in an inverted state. On a fore end of the refeed path 141, there is disposed a refeed roller 142 for refeeding a sheet to an image forming position (transfer position).

The outer discharge roller 148 is disposed in the vicinity of the discharge flapper 146, and a sheet whose course is switched to the conveying path 138 by the discharge flapper 146 is discharged from the image forming apparatus 100 by the outer discharge roller 148. In the case of discharging a sheet from the image forming apparatus 100 after inverting the same, the discharge flapper 146 is shifted upward, and the sheet is conveyed into the inverting path 139 by an inverting roller 149 until the trailing end of the sheet passes by an inverting flapper 150. Then, the inverting flapper 150 is switched, and the inverting roller 149 is reversely rotated, whereby the sheet is conveyed toward the outer discharge roller 148 after being inverted.

An automatic document feeder (ADF) 170 automatically feeds an original to a position where the original can be read by the scanner 102.

The ADF 170 is comprised of an original tray 171 on which a maximum of one hundred originals can be placed, an original feed roller 172 for feeding originals, an original side inverting roller 173 for enabling double-sided reading of an original fed by the original feed roller 172, and an original conveying belt 174.

The original conveying belt 174 conveys an original conveyed by the original feed roller 172 or the original side inverting roller 173, onto the platen glass 101. The original conveying belt 174 is controlled to stop the original in a reading position, and then discharge the original onto an original discharge tray 175, provided that in the case of reading the reverse side of the original, it is controlled to return the original to the original side inverting roller 173 before discharging the same onto the original discharge tray 175. The original discharge tray 175 can also have a maximum of one hundred originals placed thereon.

Units of the clear coating apparatus 200, which are designated by respective numerals 209 to 250 correspond to the units of the image forming apparatus 100, which are designated by respective numerals 109 to 150, and therefore duplicate description thereof is omitted.

An exposure control unit 209 of the clear coating apparatus 200 will be described in detail hereinafter with reference to FIG. 4. A developing device 213 contains a clear-colored toner. The clear toner originally has a whitish color, and becomes clear or transparent when heated by a fixing device.

A sheet with an image formed by the image forming apparatus 100 is conveyed into the clear coating apparatus 200 by the outer discharge roller 148. The sheet is received by a roller in the clear coating apparatus 200 and conveyed toward a registration roller 243. An image forming operation and sheet conveying and discharging operations carried out thereafter are the same as those performed by the image forming apparatus 100.

Figure 2:
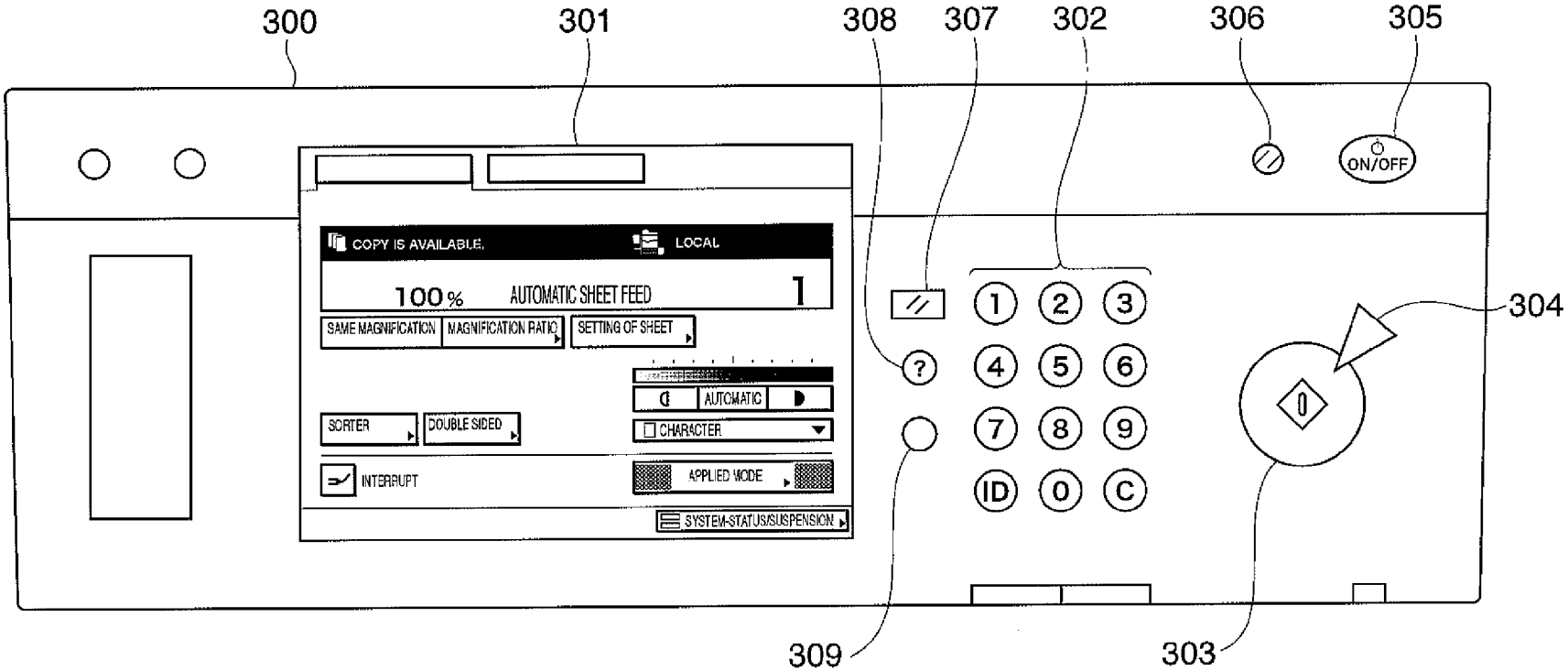
FIG. 2 is a view of an operation panel of an image forming apparatus appearing in FIG. 1.

FIG. 2 is a view of an operation panel of the image forming apparatus 100 in FIG. 1.

As shown in FIG. 2, the operation panel 300 is comprised of an LCD display section 301, a ten-key numeric keypad 302, a start key 303, a stop key 304, a soft power key 305, a power-saving mode key 306, a reset key 307, a guide key 308, and a user mode key 309.

The touch panel-type LCD display section 301 is used to perform mode setting and status display. The ten-key numeric keypad 302 is comprised of input keys for inputting numerals 0 to 9 and a clear key for returning a set value to a default value. The start key 303 is pressed by a user so as to execute a copying function or a scanning function.

The stop key 304 is pressed by the user so as to stop a job which is being carried out using the copying function, the printing function, or the scanning function. The soft power key 305 is pressed by the user so as to turn off the powers of respective loads, such as motors, of the image forming apparatus 100, and keep a CPU and networking active.

The power-saving mode key 306 is pressed by the user so as to perform temperature adjustment control of the fixing device 145 at a level set in a user mode. The reset key 307 is pressed so as to reset a function set via the LCD display section 301 or the ten-key numeric keypad 302 to a default value.

The guide key 308 is pressed by the user so as to display an explanation of each of the copying function, the printing function, the scanning function, and user modes to be set/executed.

The user mode key 309 is pressed by the user so as to set an adjustment mode for executing an adjustment item, such as gradation correction, which the user is allowed to execute as desired, as well as to carry out various kinds of network configurations, including IP address setting.

The user can designate an operation mode, such as a single-sided clear coating mode or a double-sided clear coating mode, by operating the operation panel 300.

FIG. 3 is a schematic diagram of the circuit configuration of the image forming apparatus 100 in FIG. 1.

Referring to FIG. 3, an operating section 400 is a circuit for controlling the operation panel 300 shown in FIG. 2. A job control section 401 is a circuit including a ROM in which are written programs for controlling the image forming apparatus 100, a RAM in which the programs are loaded, and a CPU that executes the programs.

The operating section 400 is connected to the job control section 401, and the job control section 401 is notified of an operation mode designated via the operating section 400. The job control section 401 generates a copy job, a scan job, or the like according to received operation mode information, based on a program stored in the job control section 401.

The job control section 401 is also connected to a reader control communication I/F 406 as a communication I/F with a CPU circuit, not shown, for controlling the scanner 102 for reading original images, and a clear coating apparatus control communication I/F 419 as a communication I/F with the clear coating apparatus 200.

Further, the job control section 401 is connected to a PDL control communication I/F 407 as a communication I/F with a CPU circuit of a PDL image control section, not shown, for expanding PDL image data received e.g. from a PC (personal computer), not shown, into a bitmap image.

Furthermore, the job control section 401 is connected to an image control section 402 that controls image data based on which a PDL image and a reader image are delivered to each of developing stations of the image forming apparatus 100, and a print control section 411 that drivingly controls the loads to form images. In short, the job control section 401 controls the overall operation of the image forming apparatus 100.

The image control section 402 is a circuit that configures image-related circuits according to a job generated by the job control section 401. In the present embodiment, the image control section 402 receives PDL image data via a PDL image I/F 408, and reader image data from a reader image I/F 409.

The image control section 402 sets an image selector 410 that determines which of the PDL image data and the reader image data is to be validated, and determines which area in an image memory 403 implemented by a volatile memory is to be used for storing the image data selected by the image selector 410, as data to be validated.

Further, the image control section 402 configures an image storage section 405 formed by a nonvolatile memory, typically by an HDD, and performs configuration for causing an image compression/expansion section 404 to compress bitmap image data received from the image memory 403 and send the compressed bitmap image data into the image storage section 405. The image control section 402 also configures the image compression/expansion section 404 for expanding compressed image data received from the image storage section 405 and sending the expanded image data to the image memory 403.

Further, the image control section 402 reads out color image data from the image memory 403 so as to actually develop and print the image data, and causes an image processing section 414 to perform desired image processing. The image processing section 414 receives and performs image processing on image data of each color delivered from the image memory 403 based on settings of the image control section 402 configured according to instructions from the job control section 401.

Further, the image control section 402 configures LUTs (Look-Up Tables) 415 such that the sensitivity characteristics of the photosensitive drum 111 is reflected on the image data.

More specifically, when an image cannot have a desired density due to change of the sensitivity characteristics of the photosensitive drum 111 or a change in the amount of laser exposure or the amount of electric charge from the primary electrostatic charger 112, each of the LUTs 415 changes the image density of input each color image data, whereby the image is converted into an image having the desired density. Each color image data having passed through an associated one of the LUTs 415 is output to an associated one of the lasers 416, and an electrostatic latent image is formed on the photosensitive drum 111 by an associated one of the developing devices 113 to 116.

Further, the print control section 411 controls a sheet conveyance control section 412 in a manner synchronous with control of a print image control section 413, such that a full-color toner image formed on the intermediate transfer member 118 is transferred onto a sheet fed from one of the sheet feed cassettes 133 to 136. Furthermore, the print control section 411 provides control such that the transferred image is fixed on the sheet through the fixing device 145. First and second patch sensors 417 and 418 are connected to the print image control section 413.

Figure 4:
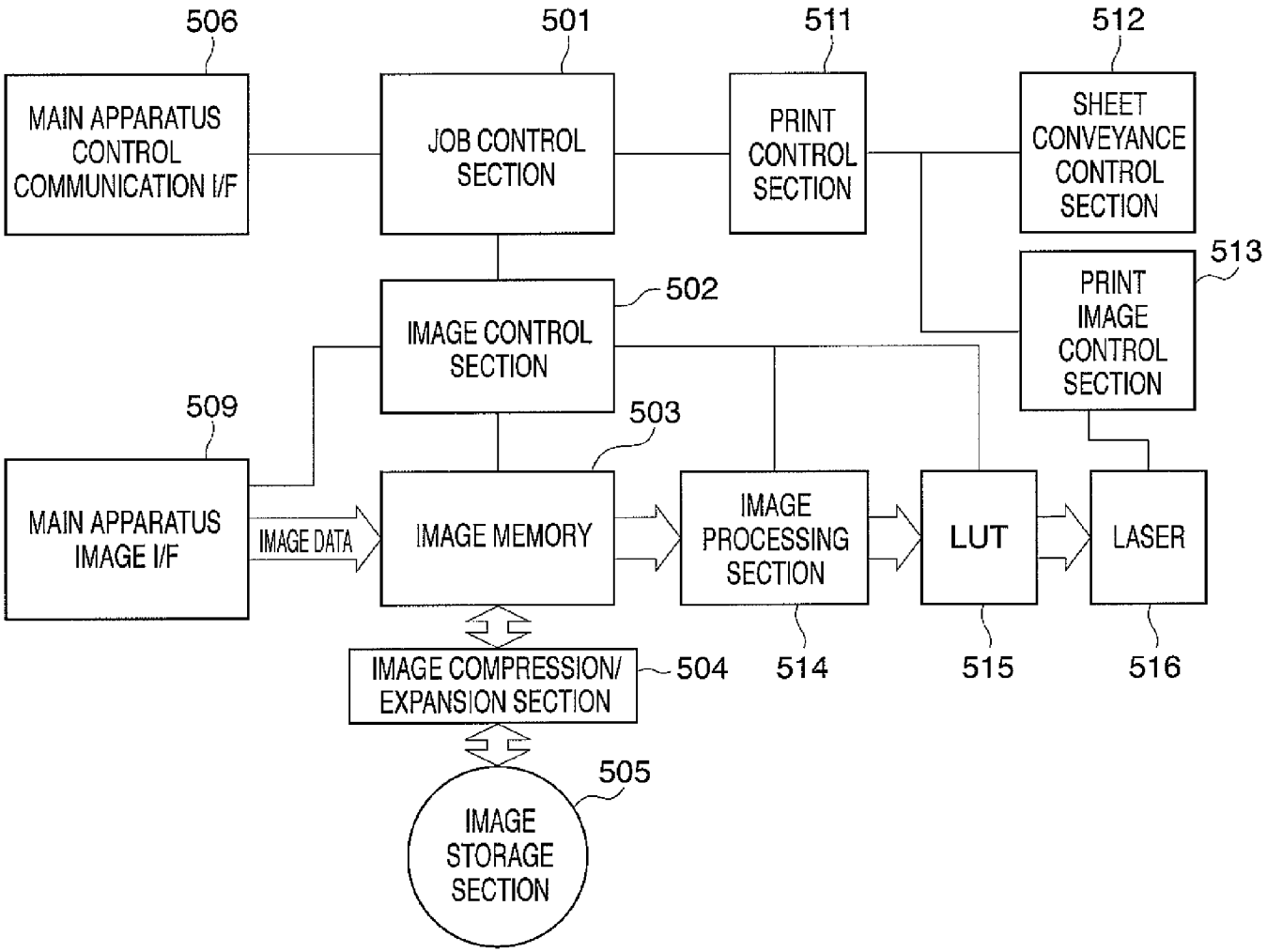
FIG. 4 is a schematic diagram of the circuit configuration of a clear coating apparatus appearing in FIG. 1.

FIG. 4 is a schematic diagram of the circuit configuration of the clear coating apparatus 200 in FIG. 1.

Referring to FIG. 4, a job control section 501 is a circuit including a ROM in which are written programs for controlling the clear coating apparatus 200, a RAM in which the programs are loaded, and a CPU that executes the programs.

A main apparatus control communication I/F 506 is connected to the job control section 501, and instructions issued from the main apparatus (image forming apparatus 100) are sent to the job control section 501 via the main apparatus control communication I/F 506.

A single-sided clear coating operation, a double-sided clear coating operation, and so forth are carried out according to operation mode information in the received instructions, based on a program stored in the job control section 501. The job control section 501 is connected to an image control section 502 and a print control section 511 that forms images by drivingly controlling loads.

The image control section 502 expands image data sent from the main apparatus via a main apparatus image I/F 509 into a bitmap image. The image control section 502 also configures image-related circuits according to a job generated by the job control section 501. In the present embodiment, image data sent to the image control section 502 via the main apparatus image I/F 509 is stored in an image memory 503.

Further, the image control section 502 configures an image storage section 505 formed by a nonvolatile memory, typically by an HDD, and performs configuration for causing an image compression/expansion section 504 to compress bitmap image data received from the image memory 503 and send the compressed bitmap image data into the image storage section 505. The image control section 502 also configures an image compression/expansion section 504 for expanding compressed image data received from the image storage section 505 and sending the expanded image data to the image memory 503. Furthermore, the image control section 502 reads out clear coating image data from the image memory 503 so as to actually develop and print the image data, and causes an image processing section 514 to perform desired image processing.

The image processing section 514 receives image data of each color delivered from the image memory 503 based on settings of the image control section 502 configured according to instructions from the job control section 501, and performs image processing thereon to deliver the processed image data to LUTs 515.

Further, the image processing section 502 configures the LUTs 515 such that the sensitivity characteristics of a photosensitive drum 211 is reflected on the image data. When an image cannot have a desired density due to change of the sensitivity characteristics of the photosensitive drum 211 or a change in the amount of laser exposure or the amount of electric charge from a primary electrostatic charger 212, each of the LUTs 515 changes the image density of input each color image data, whereby the image is converted into an image having the desired density. Each color image data having passed through an associated one of the LUTs 515 is output to an associated one of lasers 516, and an electrostatic latent image is formed on the photosensitive drum 211 by the developing device 213.

Further, the print control section 511 controls a sheet conveyance control section 512 in a manner synchronous with control of the print image control section 513, such that a clear toner image formed on an intermediate transfer member 218 is transferred onto a sheet conveyed from the image forming apparatus 100. Furthermore, the print control section 511 provides control such that the transferred image is fixed on the sheet through a fixing device 245.

Figure 5:
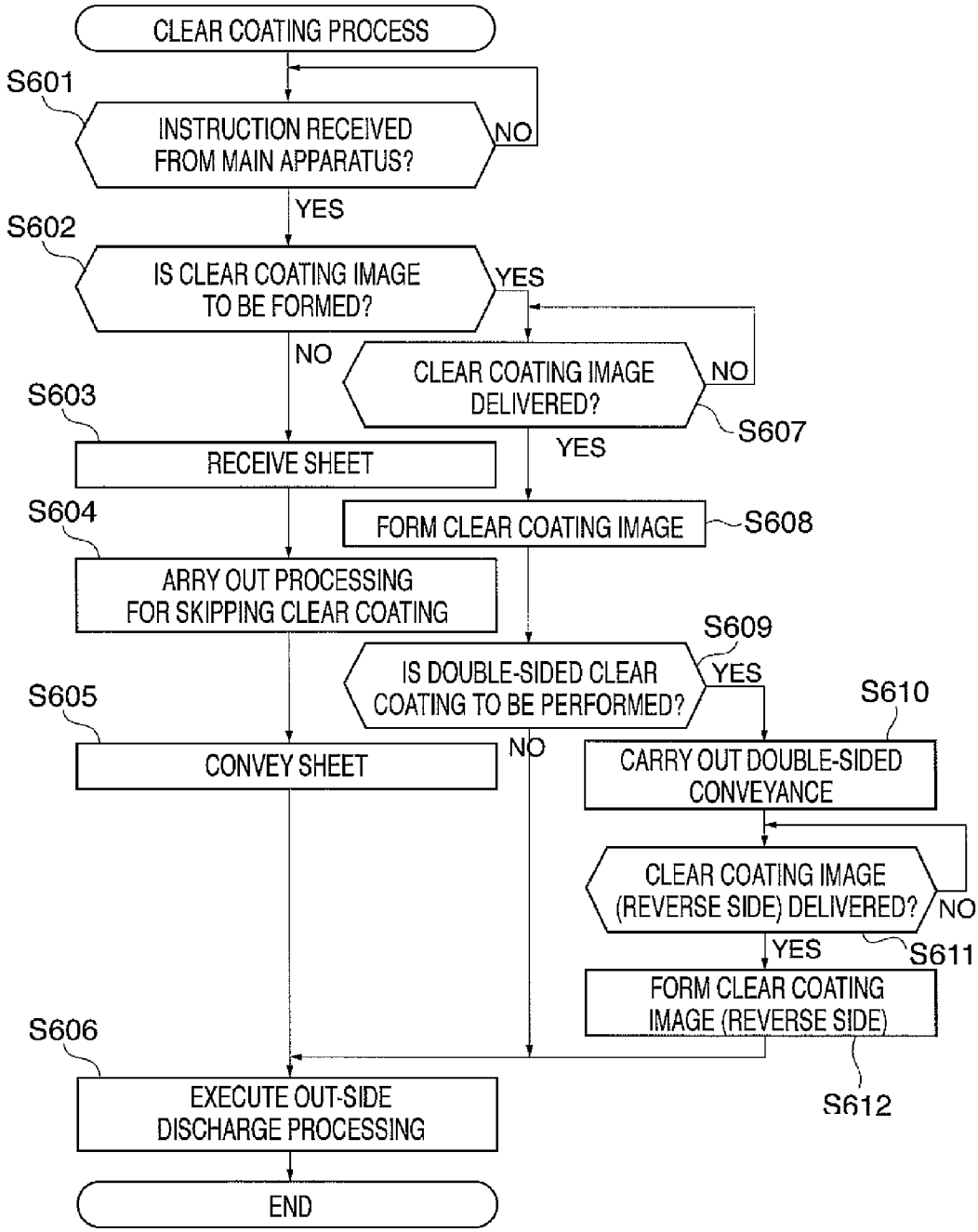
FIG. 5 is a flowchart of a clear coating process executed by the image forming system in FIG. 1.

FIG. 5 is a flowchart of a clear coating process executed by the image forming system shown in FIG. 1.

The present process is executed by the job control section 401 in FIG. 3 and the job control section 501 in FIG. 4.

Referring to FIG. 5, it is checked in a step S601 whether or not a request for an operation has been received from the main apparatus (image forming apparatus 100). This step is repeatedly carried out before the operation is started.

When a request for an operational arrives, the process proceeds to a step S602, wherein it is determined, based on instruction data sent from the image forming apparatus, whether or not clear coating is to be performed. If clear coating is to be performed, the process proceeds to a step S607, whereas if not, the process proceeds to a step S603. In the step S603, sheet passing processing is carried out so as to discharge a sheet from the apparatus without carrying out clear coating, and then the process proceeds to a step S604. In the step S604, processing for skipping clear coating is executed, and then the process immediately proceeds to a step S605.

In the step S605, the sheet is conveyed without undergoing any processing, and if an instruction for inverted discharge has been received, the sheet is inverted, followed by the process proceeding to a step S606. In the step S606, outside-discharge processing is executed. Although a detailed description is omitted, if a device for delivering a sheet outside from the apparatus is provided, the processing by the device is executed, whereas if not, control is performed in consideration of stacking performance, followed by terminating the process.

In the step S607, image passing from the image forming apparatus 100 is executed (if there is no image, this step is skipped). When there is no image, a whole surface of a sheet can be covered by a clear coating image, for example). Next, in a step S608, clear coating is performed on the sheet in the same manner as image formation is performed in a normal image forming process.

In a step S609, it is determined whether or not double-sided clear coating is to be performed. If double-sided clear coating is to be performed, the process proceeds to a step S610, whereas if not, the process immediately proceeds to the outside-discharge processing (step S606).

In the step S610, the sheet is conveyed to a double-sided conveying section, and clear coating image data for the reverse side of the sheet is acquired. The processing, including double-sided conveyance, in this step is similar to that carried out by the image forming apparatus 100, and hence detailed description thereof is omitted. Then, the process proceeds to a step S611, wherein it is determined whether or not clear coating image data for the reverse side of the sheet has been received. If the image data has been received, the process proceeds to a step S612. In the step S612, the same processing as executed in the step S608 is carried out. Then, the process proceeds to the step S606, followed by terminating the present process.

As described above, according to the first embodiment of the present invention, it is possible to provide a clear coating apparatus which is capable of performing double-sided clear coating and has enhanced versatility. Further, according to the first embodiment, since the clear coating apparatus 200 carries out double-sided clear coating after execution of a double-side image forming process by the image forming apparatus 100, the number of times of passage of a front-side clear toner through the fixing device and the number of times of passage of a reverse-side clear toner through the fixing device differ by only one time. Therefore, the first embodiment makes it possible to reduce the difference in glossiness between the front and reverse sides of a sheet, thereby improving the quality of an output product.

Figure 6:
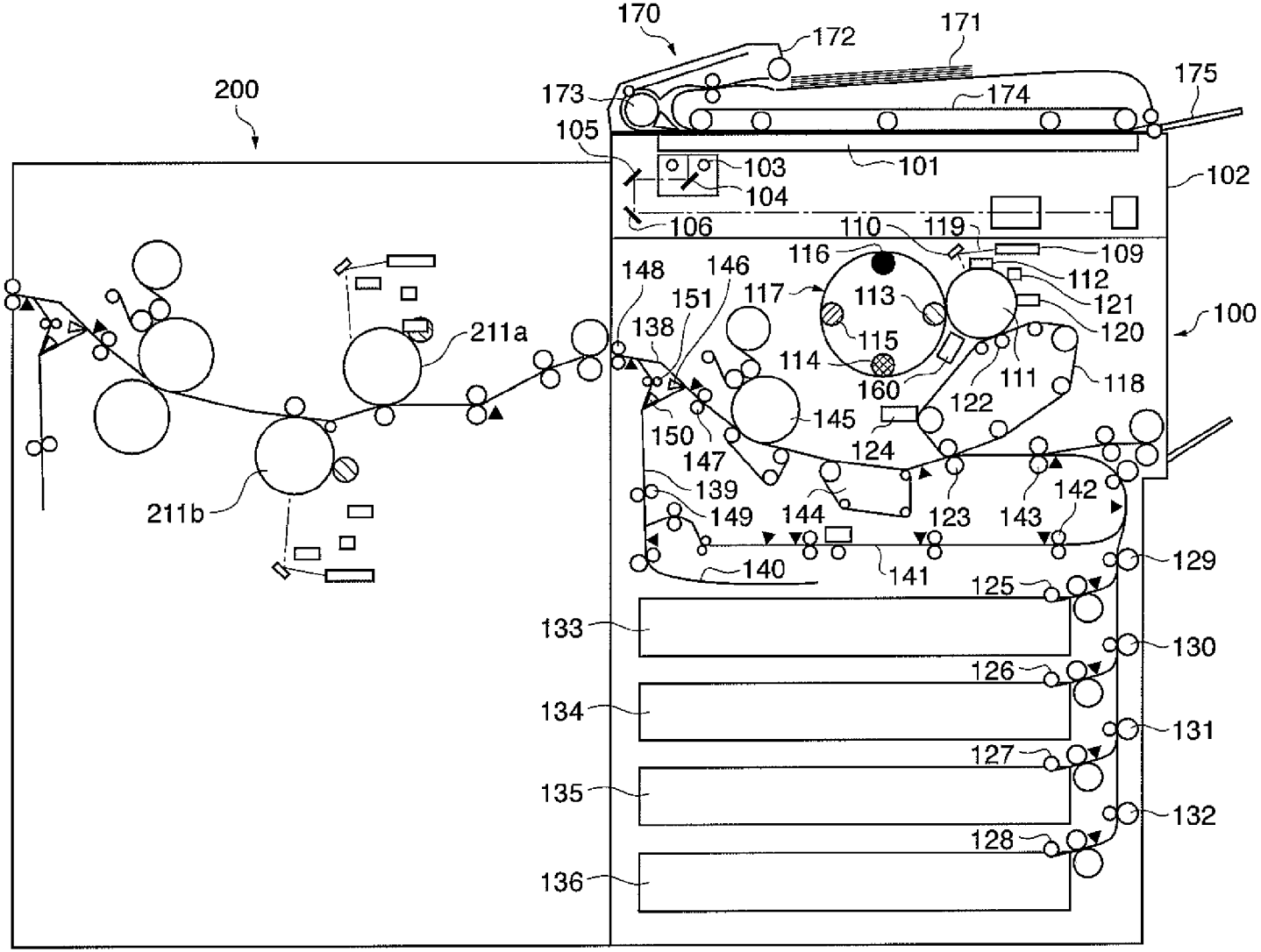
FIG. 6 is a schematic view of an image forming system according to a second embodiment of the present invention.

FIG. 6 is a schematic view of an image forming system according to a second embodiment of the present invention.

Although the image forming apparatus according to the first embodiment, shown in FIG. 1, has the clear coating apparatus 200 provided with the automatic double-sided mechanism, the image forming system according to the second embodiment, shown in FIG. 6, has the clear coating apparatus 200 provided with a photosensitive drum 211*a* for the front side of a sheet and a photosensitive drum 211*b* for the reverse side of the sheet so as to perform clear coating on the front and reverse sides of the sheet simultaneously.

Therefore, according to the second embodiment as well, it is possible to provide a clear coating apparatus which is capable of performing double-sided clear coating and has enhanced versatility. Further, according to the second embodiment, since the clear coating apparatus 200 carries out double-sided clear coating during a single sheet conveying operation after execution of a double-side image forming process by the image forming apparatus 100, it is possible to make the number of times of passage of a front-side clear toner through the fixing device equal to the number of times of passage of a reverse-side clear toner through the fixing device. Therefore, the second embodiment makes it possible to reduce the difference in glossiness between the front and reverse sides of a sheet, thereby improving the quality of an output.

While the present invention has been described with reference to exemplary embodiments, it is to be understood that the invention is not limited to the disclosed the embodiments. The scope of the following claims is to be accorded the broadest interpretation so as to encompass all such modifications and equivalent structures and functions.

This application claims the benefit of Japanese Patent Application No. 2006-153665, filed Jun. 1, 2006 which is hereby incorporated by reference herein in its entirety.

What is claimed is:

1. An image forming system comprising:

an image forming apparatus configured to form an image on a sheet; and a clear coating apparatus configured to perform clear coating on the sheet using clear toner;

wherein said image forming apparatus is provided with a double-sided image forming function for forming images on respective opposite sides of a sheet;

wherein said clear coating apparatus is provided with a double-sided clear coating function for performing clear coating on opposite sides of the sheet;

wherein said image forming apparatus forms images on respective opposite surfaces of a sheet and then delivers the sheet to said clear coating apparatus; and wherein said clear coating apparatus performs clear coating on the opposite surfaces of the delivered sheet.

2. An image forming system as claimed in claim 1, wherein said image forming apparatus and said clear coating apparatus are disconnectably connected to each other.

3. An image forming system as claimed in claim 1, wherein said clear coating apparatus comprises a receiving part configured to receive a sheet discharged from said image forming apparatus.

4. An image forming system as claimed in claim 3, wherein said clear coating apparatus forms a clear coating image on the sheet received by said receiving part.

5. An image forming system as claimed in claim 1, wherein said clear coating apparatus comprises two photosensitive members.

6. An image forming system as claimed in claim 1, wherein said image forming apparatus and said clear coating apparatus comprise respective control sections; and wherein said control sections are connected to each other via a communication I/F.

7. An image forming system comprising:

an image forming apparatus configured to form an image on a sheet; and a clear coating apparatus configured to perform clear coating on the sheet using clear toner;

wherein said image forming apparatus is provided with a double-sided image forming function for forming images on respective opposite sides of a sheet;

wherein said clear coating apparatus is provided with a double-sided clear coating function for performing clear coating on opposite sides of the sheet;

wherein said image forming apparatus and said clear coating apparatus comprise respective control sections; and wherein said control sections are connected to each other via a communication I/F.

8. An image forming system as claimed in claim 7, wherein said image forming apparatus and said clear coating apparatus are disconnectably connected to each other.

9. An image forming system as claimed in claim 7, wherein said clear coating apparatus comprises a receiving part configured to receive a sheet discharged from said image forming apparatus.

10. An image forming system as claimed in claim 9, wherein said clear coating apparatus forms a clear coating image on the sheet received by said receiving part.

11. An image forming system as claimed in claim 7, wherein said clear coating apparatus comprises two photosensitive members.

* * * * *